US005263916A

United States Patent [19]

Bobich

[11] Patent Number: 5,263,916

[45] Date of Patent: Nov. 23, 1993

[54] RESILIENT EXERCISE DEVICE

[76] Inventor: John L. Bobich, P.O. Box 46, Round Mountain, Calif. 96084

[21] Appl. No.: 919,987

[22] Filed: Jul. 27, 1992

[51] Int. Cl.[5] ..... A63B 21/02

[52] U.S. Cl. ..... 482/124; 482/121; 482/125; 482/74; 482/139

[58] Field of Search ..... 482/121, 122, 123, 124, 482/125, 139, 74, 126

[56] References Cited

U.S. PATENT DOCUMENTS

| | | | |
|---|---|---|---|
| 843,478 | 2/1907 | Muller . | |
| 866,495 | 9/1907 | Marks . | |
| 1,012,802 | 12/1911 | Brogan . | |
| 1,618,273 | 2/1927 | Davidson . | |
| 2,097,376 | 10/1937 | Marshman | 482/124 |
| 2,498,006 | 2/1950 | Ridill | 482/124 |
| 3,529,820 | 9/1970 | Templeton . | |
| 3,838,852 | 10/1974 | Gury | 482/125 |
| 4,033,580 | 7/1977 | Paris . | |
| 4,245,840 | 1/1981 | Van Housen . | |
| 4,544,155 | 10/1985 | Wallenbrock et al. | 482/139 |
| 4,852,874 | 8/1989 | Sleichter, III et al. . | |
| 4,909,505 | 3/1990 | Tee . | |
| 5,186,701 | 2/1993 | Wilkinson | 482/125 |

*Primary Examiner*—Richard J. Apley
*Assistant Examiner*—Lynne A. Reichard
*Attorney, Agent, or Firm*—James M. Ritchey

[57] ABSTRACT

An exercise and physical therapy device having a central elongated resilient element with a wrist attachment strap at one end and a foot attachment strap at the other end. The device is configured so that the foot strap fits comfortably inside the user's shoe, allowing the device to be used simultaneously while performing walking, running, or other exercises.

2 Claims, 3 Drawing Sheets

RESILIENT EXERCISE DEVICE

BACKGROUND OF THE INVENTION

1. Field of the Invention

The Invention related herein is a resilient exercise and physical therapy device. Specifically, an exercise apparatus that can be worn by a user during physical therapy, walking, jogging, running, or other aerobic types of exercise is disclosed. The subject apparatus comprises a central elongated resilient or elastic body element, with a reversibly attachable wrist at one end, and a reversibly attachable foot strap at the other end. The foot strap is configured and structured to be worn inside the shoe of the user and wraps around the user's foot or foot and removable shoe insole.

2. Description of the Background Art

A variety of tension-based resilient exercise devices have been devised in the past to meet a number of personal exercise and training requirements. However, the prior art has not addresses the need for an resilient exercise device that can be worn in a fashion that leaves the hands and feet of the user free to simultaneously engage in walking, jogging, or running exercises. The various resilient exercise devices disclosed in the past do not lend themselves well to simultaneous use during walking and running types of exercise.

U.S. Pat. No. 843,478 discloses a physical exerciser having a belt worn about the waist, and two elastic cords attached to the belt through guide rings. Both elastic cords have hand grips at one end, and foot harnesses at the other end.

Described in U.S. Pat. No. 866,495 is a similar exercising device with two elastic cords, each having hand grips at one end and a foot stirrup at the other end. The elastic cords are attached to a belt worn about the waist by guide rings that are on movable slides that can be positioned about the belt.

U.S. Pat. No. 1,012,802 presents an exercising device based on a non-elastic member having handles at each end. The handles are movable and can be adjusted to the user's outstretched arm span.

Related in U.S. Pat. No. 1,618,273 is a body exerciser having a waist encircling belt, a chest encircling belt, and two elastic members that run down the back of the user's leg to foot pieces. Two elastic members extend from the back of the chest encircling belt with hand grips on the ends, and are worn over the user's shoulders. Another elastic member extends from the back of the chest encircling belt to a head piece.

A device for training golfers is disclosed in U.S. Pat. No. 2,498,006, having an elongated resilient member with a wrist encircling element at one end and a heel attachment at the other end. The device is adjustable to apply resistance at the desired point of the user's golf stroke.

U.S. Pat. No. 3,529,820 presents a bust development device having an elastic cord with elbow harnesses at each end. The device is worn behind the user's back.

An elastic type exercising apparatus is related in U.S. Pat. No. 4,033,580 having at least four elastic straps joined at a central junction at one end, and terminating in handles at the other end. The handles permit the user to grip more than one elastic strap at a time in order to increase the amount of tension during the exercise.

U.S. Pat. No. 4,245,840 discloses a resistive exercise device utilizing two elastic members having handles at one end and loops at the other end. The two elastic members are held together by an adjustable clip connector that can slide along the elastic members and vary the tension of the device.

A portable isokinetic exercise device is described in U.S. Pat. No. 4,825,874 comprising an elastic loop having two handles and a central elastic retainer sleeve that contains the elastic loop between the handles.

Most recently, a selectively connectable resilient exercise apparatus is presented in U.S. Pat. No. 4,909,505 having an resilient tube with a connectable hand grip and connectable foot strap. Additional resilient rings can be added to increase the resistance of the apparatus as the user increases strength.

SUMMARY OF THE INVENTION

An object of the present invention is to provide a resistive resilient exercise device to enhance muscle development and physical fitness of the user.

More specifically, it is the object of the present invention to produce an resilient exercise device that can be worn leaving both the hands and feet of the user free to engage in walking or running exercise while using the exercise device.

Another object of the present invention is to relate an resilient exercise apparatus with a foot attachment strap adapted to be worn comfortably inside the user's shoe so that the user can move about freely without fear of the foot strap slipping off.

A further object of the present invention is to provide a resilient exercise device having a wrist attachment strap that leaves the user's hands free to grip other exercise equipment.

Disclosed is an exercise device comprising an elongated resilient element having a first end and a second end. A wrist attachment means is connected with the first end of the resilient element, and a foot attachment means is connected to the second end of the resilient element. Preferably the hand and foot attachment means are fabric straps with VELCRO fasteners, with the foot strap fitting comfortably inside the shoe of the exercise device user. Generally, the exerciser will use two resilient exercise devices simultaneously, with one device connecting the right wrist and right foot, and the second device connecting the left wrist and left foot.

Other objects, advantages, and novel features of the present invention will become apparent from the detailed description that follows, when considered in conjunction with the associated drawings.

DESCRIPTION OF THE PREFERRED EMBODIMENT

Figure 1:
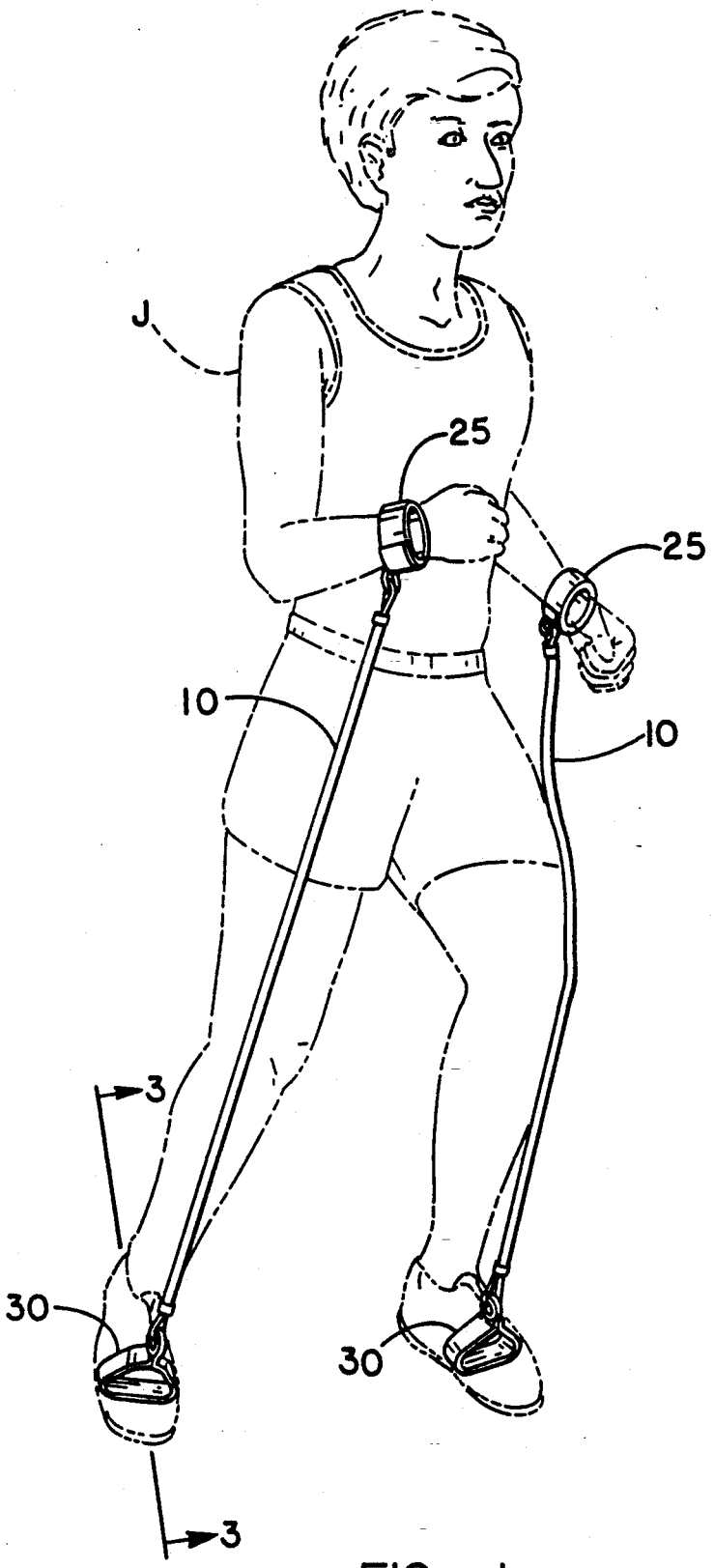
FIG. 1 is a perspective view of a preferred embodiment of the resilient exercise device in accordance with the invention disclosed herein as being utilized by a user to exercise.
Figure 2:
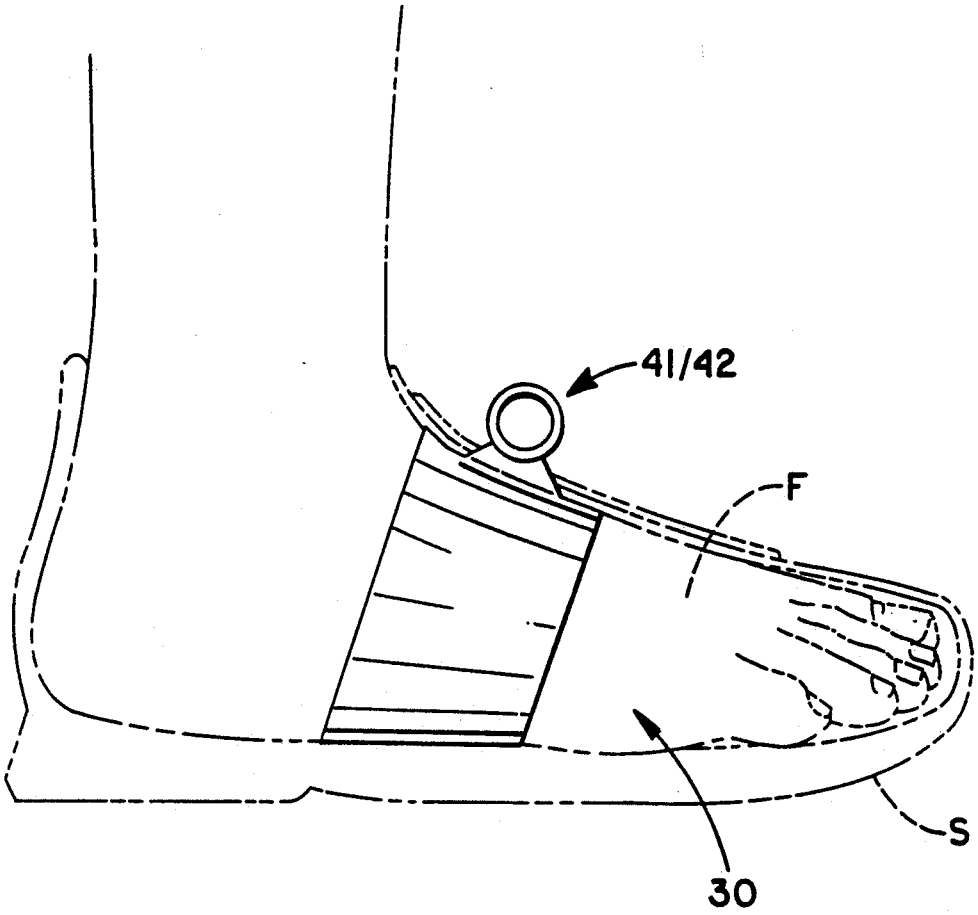
FIG. 2 is a view illustrating the foot attachment means about the user's foot and inside the user's shoe.
Figure 3:
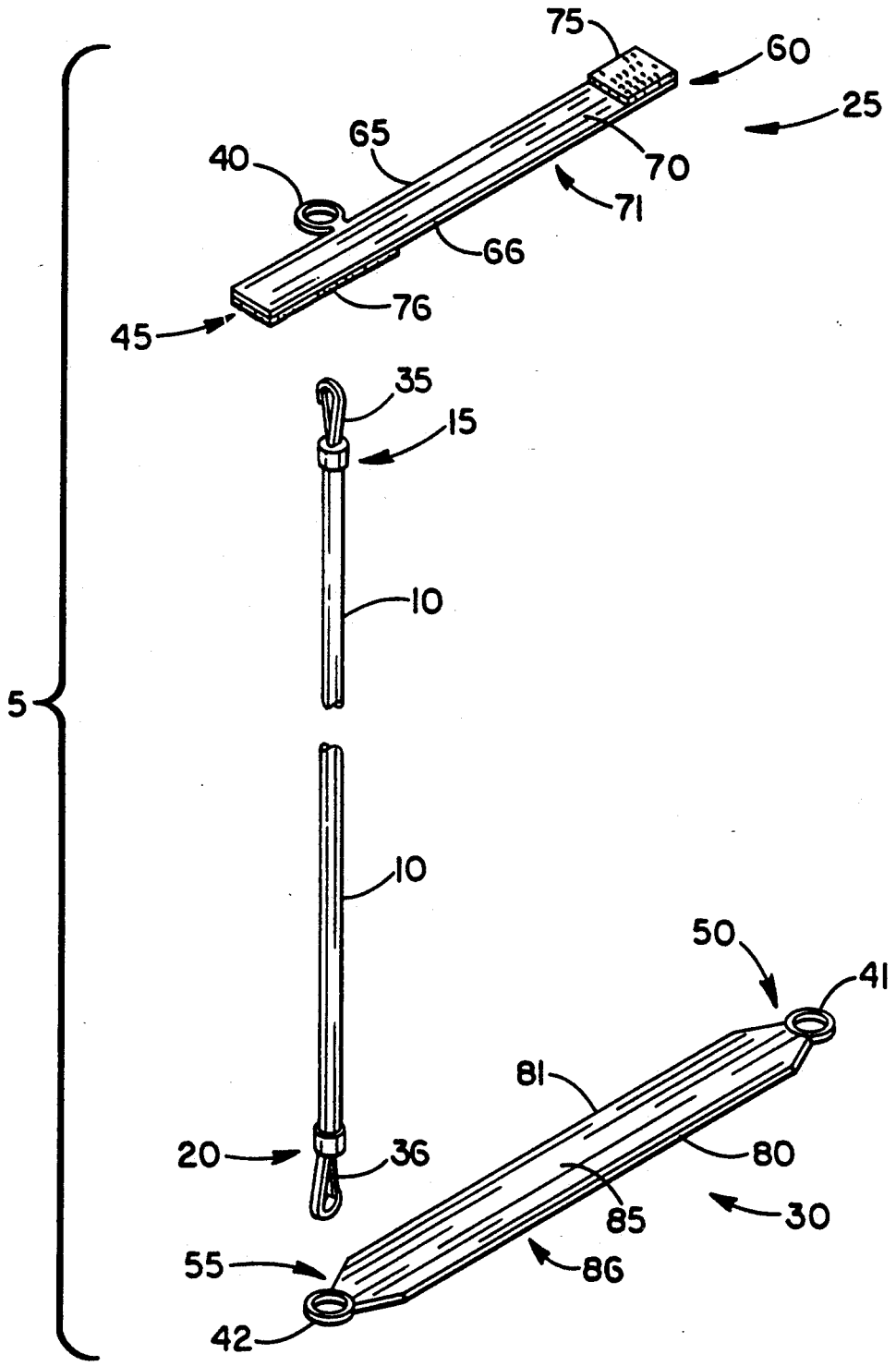
Fig. 3 is an exploded view of the subject invention.

Referring now to FIGS. 1-3, there is shown a preferred embodiment of a resilient exercise and physical therapy device. The device is utilized by a user, exerciser, walker, or jogger J. The subject invention 5 comprises a resilient elongated element 10 having a first end 15 and a second end 20. Coupled to the resilient element first end 15 is a wrist attachment means, preferably a flattened wrist strap 25, and coupled to the second end 20 is a foot attachment means, preferably a flattened foot strap 30 as shown in FIGS. 1-3.

The resilient element 10 is preferably a cord such as a BUNGEE cord, but may be a resilient tube, strap, spring, or spring that is housed in a resilient or non-resilient cylindrical housing. The resilient element 10 may also comprise a loop of cord, tube, strap, or spring, with the first end 15 and second end 20 being where the wrist attachment means 25 and foot attachment means 30 are coupled to the loop.

Means for attaching the wrist strap 25 to the resilient element first end 15 are shown in FIG. 1 as comprising a reversibly attaching clip 35 and a ring 40 which inserts into the clip 35. The reversible clip 35 is fastened to the resilient element first end 15, and the ring 40 is fastened to the wrist strap first end 45. It is understood, however, that equivalent reversible attachment means such as clamps, buttons, zippers, VELCRO, or other similar means of attachment are contemplated as within the scope of this disclosure.

Means for attaching the foot strap 30 to the resilient element second end 20 are shown in FIGS. 1 and 3 as comprising a reversible clip 36 and rings 41 and 42 that insert into clip 36. The reversible clip 36 is fastened to the resilient element second end 20, and ring 41 is attached to the foot strap first end 50 and ring 42 is attached to the foot strap second end 55. As with the wrist strap 25, all other equivalent reversible fastening means that are used in the art may are possible means of attaching the foot strap 30 to the resilient element second end 20. The reversible clips 35 and 36 and rings 40, 41, and 42, or other attachment means, are preferably made of a durable, lightweight material such as a natural or synthetic polymer, but wood, metal, ceramic, or other materials are also contemplated.

The wrist attachment means of the subject invention is preferably a flattened wrist strap 25, having a first end 45 and a second end 60, two side edges 65 and 66, and two flat surfaces 70 and 71. Generally the wrist strap 25 is made of fabric or leather. In the embodiment shown in FIGS. 1 and 3, a ring 40, which fits the reversible clip 35, is attached to the wrist strap side edges 65 and 66 adjacent the wrist strap first end 45. However, the ring 40 may be attached to the wrist strap first end 45 or to the wrist strap flat surfaces 70 and 71 as well the wrist strap side edges 65 and 66. Preferably, VELCRO fasteners 75 on the wrist strap flat surfaces 70 and 71 allow for reversible attachment to the user's J wrist. Other fastening means such as buttons, zippers, clips, laces, or cords are also contemplated here. A cinch or other adjusting method may be used to control the length of the wrist strap 25. It should be readily understood that wrist attachment means other than a strap, such as a resilient or non-resilient tubes, bands, or bracelets are also considered as within the realm of the subject invention.

The foot attachment means is preferably a flattened foot strap 30 having a first end 50, a second end 55, two side edges 80 and 81, and two flat surfaces 85 and 86 as shown in FIGS. 1-3. Since many athletic shoes have removable insoles, for additional comfort, strength, and drying characteristics, the foot strap 30 may wrap around both the user's foot F and an insole. The foot strap 30 is preferably made of a material that can be comfortably worn around the user's foot F, inside the user's shoe S (see FIG. 2 for details). Suitable materials are used to fabricate the wrist strap 25 and foot strap 30 such as natural and synthetic polymers (like DACRON) and combinations, leather, fabric, and the like.

A first coupling means comprising a ring 41, which fits the reversible clip 36, is attached to the foot strap first end 50. A second coupling means comprising a ring 42, which fits the reversible clip 36, is attached to the foot strap second end 55. It is contemplated that the rings 41 and 42 may also be attached to the foot strap side edges 80 and 81 or foot strap flat surfaces 85 and 86 as well. As with the wrist strap 25, coupling means other than the rings 41 and 42 and clip 36 shown are considered as within the scope of the subject invention.

FIG. 2 shows that the foot strap is generally worn encircling the user's foot F, with the rings 41 and 42 on the foot strap first end 50 and second end 55, respectively, pointing upward, atop the user's foot F, so that the rings 41 and 42 and reversible clip 36 can be fastened outside the shoe S. The general shape of the foot strap 30 is depicted in FIGS. 1-3 as being roughly rectangular with tapered ends 50 and 51, however, to facilitate fitting the foot strap ends 50 and 51 through the laces of the shoe S the foot strap 30 is decreased the width between the side edges 80 and 81 (either gradually of step-wise) towards each end 50 and 55. Preferably, the rings 41 and 42 and reversible clip 36 are configured to fit between the laces or fasteners of the shoe S, allowing the exercise device to be worn with standard exercise or walking shoes.

Generally, the exerciser J will wear two of the resilient exercise devices 5 at the same time, with one device connecting the right wrist and right foot, and the second device connecting the left wrist and left foot. If desired, the user J can attach or clip both devices together to minimize any interference between the resilient elements 10 of the two devices. In addition to exercise, the subject invention is employed in physical therapy after an accident or inactivity by the user J to aid in reestablishing cross crawl developmental processes.

As the exerciser gains in strength while using the resilient exercise device, the resilient members can be uncoupled from the wrist and foot straps and replaced by a more resistive resilient member to allow further muscle development. Further, adjustable length and resistance resilient members are contemplated as being within the realm of this disclosure.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An exercise device to be employed by a user in combination with an athletic shoe, comprising:

a) an athletic shoe;

b) an elongated resilient element having a first end and a second end;

c) wrist attachment means associated with said first end of said resilient element that is configured and structured to attach to a wrist of the user; and d) means for securing said wrist attachment means to said first end of said elongated element; and e) foot attachment means associated with said second end of said resilient element that is configured and structured to fit within said shoe and around the user's foot, wherein said foot attachment means comprises;

a flattened strap having first and second ends;

first coupling means associated with said strap first end that is configured and structured to fit between the laces or straps of said shoe;

second coupling means associated with said strap second end that is configured and structured to fit between the laces or straps of said shoe; and attachment means associated with said second end of said resilient element that will reversibly attach to said first coupling means and said second coupling means outside said shoe.

2. An exercise device to be employed by a user in combination with a pair of athletic shoes, comprising a pair of athletic shoes and a pair of elongated members, wherein each said elongated member comprises:

a) a resilient element having a first end and a second end;

b) wrist attachment means configured and structured for reversibly attaching to a wrist of the user;

c) means for securing said wrist attachment means to said first end of said resilient element; and d) foot attachment means associated with said second end of said resilient element that is configured and structured to fit within one shoe of said pair of athletic shoes and around the user's foot for securing the user's foot to the exercise device, wherein said foot attachment means comprises;

a flattened strap having first and second ends;

first coupling means associated with said strap first end that is configured and structured to fit between the laces or straps of said shoe;

second coupling means associated with said strap second end that is configured and structured to fit between the laces or straps of said shoe; and attachment means associated with said second end of said resilient element that will reversibly attach to said first coupling means and said second coupling means outside said shoe.

* * * * *